United States Patent [19]

Freund

[11] Patent Number: 5,006,064

[45] Date of Patent: Apr. 9, 1991

[54] FURNACE SEAL

[75] Inventor: William P. Freund, Lakewood, Ohio

[73] Assignee: Alloy Engineering Company, Berea, Ohio

[21] Appl. No.: 458,320

[22] Filed: Dec. 28, 1989

[51] Int. Cl.[5] ..... F27B 5/04

[52] U.S. Cl. ..... 432/205; 432/206

[58] Field of Search ..... 432/196, 206, 205, 242

[56] References Cited

U.S. PATENT DOCUMENTS

| | | | |
|---|---|---|---|
| 3,081,074 | 3/1963 | Blackman et al. . | |
| 3,114,539 | 12/1963 | Wilson et al. . | |
| 3,179,394 | 4/1965 | Sims et al. . | |
| 3,184,225 | 5/1965 | Wilson . | |
| 3,411,763 | 11/1968 | Blackman et al. | 432/206 |
| 3,554,511 | 1/1971 | Wald | 432/206 |
| 3,572,666 | 3/1971 | Fehr | 432/206 |
| 3,596,891 | 8/1971 | Hill . | |
| 4,813,654 | 3/1989 | Singler . | |
| 4,846,675 | 7/1989 | Soliman | 432/206 |
| 4,867,675 | 9/1989 | Blackman | 432/205 |

*Primary Examiner*—Henry C. Yuen

*Attorney, Agent, or Firm*—Watts, Hoffmann, Fisher & Heinke

[57] ABSTRACT

A gas seal for a bell-type annealing furnace is described. A ring supported by the furnace cover and a resilient pad supported by the base mate to form a gas seal when the cover is rested on the base. A cover-supported cooling jacket and a base-supported cooling jacket cooperate to enclose the seal when the cover is rested on the base. Load bearing structure is provided independent of the seal elements to avoid subjecting the seal elements to the weight of the furnace cover.

7 Claims, 1 Drawing Sheet

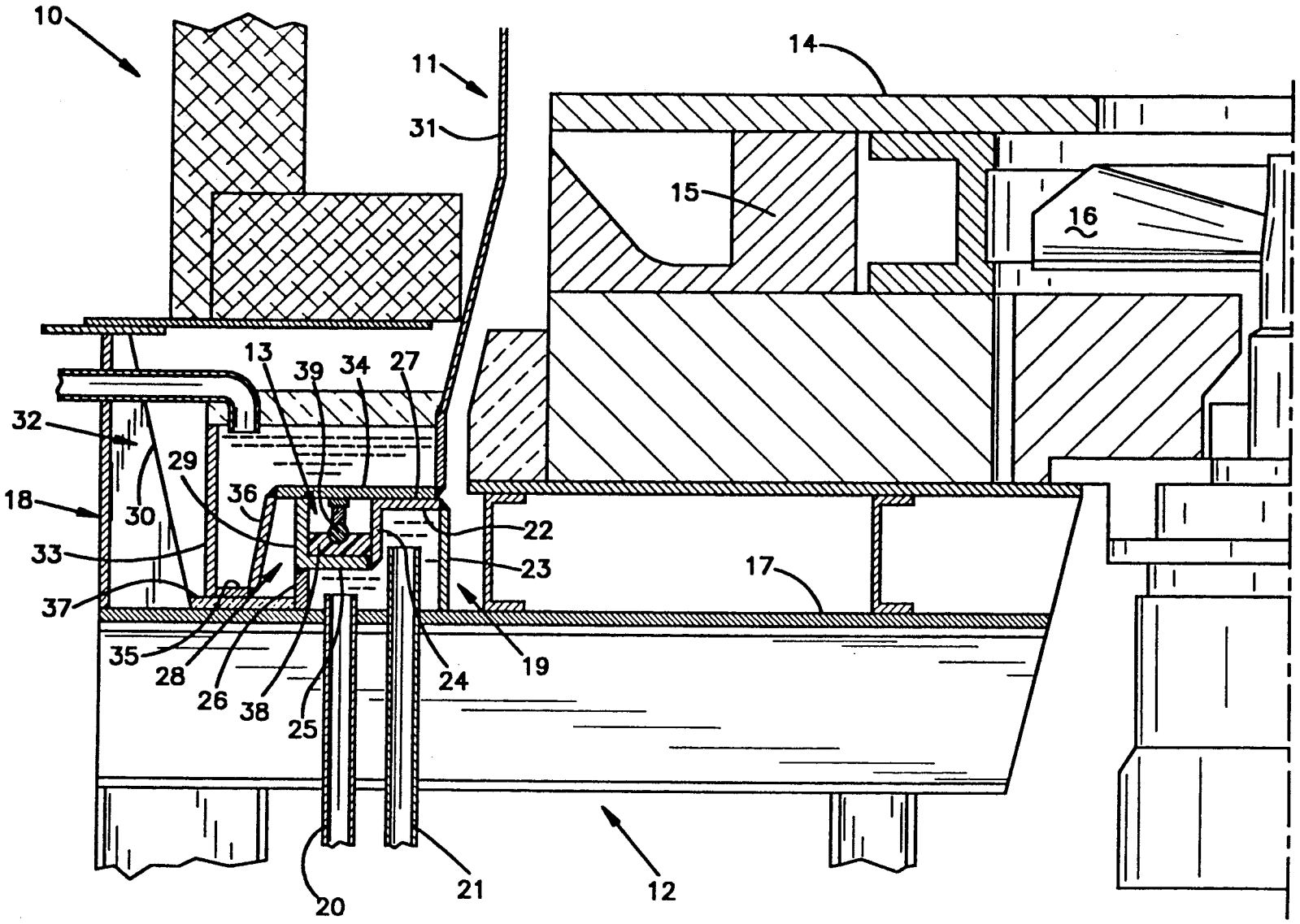
10
11
12
13
14
15
16
17
18
19
20
21
22
23
24
25
26
27
28
29
30
31
32
33
34
35
36
37
38
39

FURNACE SEAL

BACKGROUND OF THE INVENTION

1. Field of the Invention

This invention relates to annealing furnaces, and more specifically, a seal for a bell-type annealing furnace.

2. Background Information

In bell-type annealing furnaces, it is necessary to provide a seal around the cover to prevent the inert atmosphere used inside the furnace from leaking out and to keep atmospheric air from leaking in. There have been many prior designs for such seals, all of which have drawbacks and limitations.

One prior art furnace seal arrangement included flanges extending into troughs filled with liquid or sand to seal the perimeter of the furnace cover. Sand filled troughs provide a poor seal since sand is inherently porous and it scatters. Trough seals filled with liquid such as oil and/or water have been unsatisfactory due to the vapors created when the liquids are heated and the inflammable nature of some liquids.

Some furnace seals employed two machined mating surfaces having an O-ring centrally mounted between them. This seal worked well but was expensive.

Another prior art seal comprised a resilient pad carried on the lower edge of the cover in position to engage a bar on the furnace base. These resilient pads were fixed to the cover with epoxy making replacement of the seal time consuming and difficult, since the pads had to be scraped out from underneath. In many prior art designs where a resilient pad was used, the weight of the cover rested on the pad. Each time the cover was lowered onto the base, the resilient pad was further compacted so that eventually it lost its elasticity and effectiveness.

At least one prior art design employed an elastomer bag-type seal mounted to the cover. A ring supported by the base contacted the bag to form a seal. The bag typically had cooling liquid pumped through its interior. This design made it difficult to align the cover with the base. Furthermore, if the bag broke and water leaked into the furnace, a steam explosion could result.

SUMMARY OF THE INVENTION

An object of the present invention is to provide an improved apparatus for sealing a bell-type annealing furnace along the interface between its base and its cover.

Another object of the invention is to provide an improved liquid-cooled seal for a bell-type annealing furnace wherein the service life of the seal is extended.

A further object of the invention is to provide a seal for a bell-type annealing furnace having a resilient pad characterized by a design facilitating replacement of the resilient pad.

Another object of the invention is to provide a seal for a bell-type furnace comprising a resilient pad compressed and deformed by a ring wherein the resilient pad comprises a material resistant to heat deterioration.

Another object of the invention is to provide a seal for a bell-type furnace having a resilient pad compressed and deformed by a ring wherein load bearing structure prevents the resilient pad from bearing the weight of the furnace cover.

The present invention achieves the foregoing objects and overcomes the disadvantages of the prior art by providing in a bell-type annealing furnace having a cover and a base: an annular resilient pad; a mounting structure for mounting the pad on the base; an annular ring carried by the cover around its periphery in position to compress and deform the annular resilient pad to affect a gas-tight seal; load bearing structure for limiting penetration of the ring into the annular resilient pad and for supporting the weight of the cover on the base; and, cooling jackets adjacent both the ring and the annular resilient pad.

In a preferred embodiment, the seal for a bell-type annealing furnace comprises a resilient pad formed with epichlorohydrin closed cell foam. In addition, cooling jackets supported by the furnace base and cover substantially surround the seal.

The apparatus of the invention facilitates replacement of the resilient pad by making the pad easily accessible from above the base when the cover is removed.

The apparatus of the invention extends the service life of the seal by cooling the seal in all directions and by employing a material that is resistent to heat deterioration.

The apparatus of the invention further extends the life of the seal by providing load bearing structure which limits the force borne by the resilient pad. This relieves the pad of repeated destructive compressions.

Other objects and advantages and a fuller understanding of the invention will be had from the following detailed description of a preferred embodiment and the accompanying drawing.

BRIEF DESCRIPTION OF THE DRAWING

The FIGURE is a vertical cross-sectional view illustrating the lower peripheral portion of a bell-type annealing furnace incorporating the improved seal of the present invention.

DESCRIPTION OF THE PREFERRED EMBODIMENT

Referring to the drawing, a bell-type furnace 10 comprises a removable cover 11 and a base 12 mounted on a foundation. The furnace seal 13 of the present invention is mounted along the interface between the removable cover 11 and the base 12.

The base 12 includes a charge support plate 14 disposed to support a charge of material within the furnace 10, a diffuser 15, a blower 16 to circulate the gas enclosed within the furnace 10, a base plate 17, and a cover guide 18. An annular base-supported cooling jacket 19 is provided on the base 12 around the furnace periphery to support and cool the seal 13.

The base-supported cooling jacket 19 comprises an annular chamber joined to the base plate 17. As seen in the drawing, the chamber of the base-supported cooling jacket 19 is L-shaped in cross section. An inlet pipe 20 and an outlet pipe 21 communicate with the interior of the L-shaped chamber to exchange cooling fluid with the cooling jacket 19. Conventional liquid cooling and pumping equipment is connected to the pipes. The cooling jacket 19 has an annular top plate 22, inner wall 23, intermediate wall 24, pad support plate 25 and outer wall 26. The top plate 22 contacts the cover 11 along an annular load-bearing ring area 27 when the cover 11 is rested on the base 12. The load bearing ring area 27 transmits substantially all of the weight of the cover 11 through the base-supported cooling jacket 19 to the base 12.

An annular trough 28 is formed on the base-supported cooling jacket 19. The annular trough is formed by intermediate wall 24, pad support plate 25 and an outer trough sidewall 29. The trough 28 faces upwards from the base 12 facilitating access to the trough when the cover 11 is removed.

The cover guide 18 is mounted on the base plate 17 at the perimeter of the base 12. The cover guide 18 comprises a plurality of angled structures 30 circularly arranged to guide the cover into proper alignment with the base 12 as the cover 11 is lowered onto the base.

The cover 11 of the furnace 10 contains gas inside the furnace and is removable to allow charges to be loaded or unloaded. The cover 11 comprises a wall 31 and a cover-supported cooling jacket 32 joined to the lower edge of the wall 31.

The cover-supported cooling jacket 32 comprises an annular chamber L-shaped in cross section as seen in the drawing. Inlet and outlet pipes communicate with the interior of the cover-supported cooling jacket 32 to exchange cooling fluid within the interior of the cooling jacket. Conventional liquid cooling and pumping equipment is connected to the pipes. The L-shaped chamber of the cooling jacket 32 is formed by an outer sidewall 33, an annular load bearing plate 34, an annular plate 35 welded to the lower edge of the sidewall, and an intermediate wall 36 welded to the inner edge of the annular plate 35 and to the outer edge of the load bearing plate 34. The load bearing plate 34 rests on the top plate 22 when the cover 11 is rested on the base 12.

The annular plate 35 of the cover-supported cooling jacket 32 is illustrated as contacting a refractory pad 37 on the base 12; however, this contact is not necessary for support of the cover 11 or sealing. Similarly, the outer sidewall 33 of the annular trough 28 is illustrated as contacting the cover 11; however, this contact is not necessary for either sealing or support.

The seal 13 of the present invention comprises a first sealing element 38 supported by the base 12 and a cooperating second sealing element 39 supported by the cover 11. A gas-tight seal is formed when the cover 11 is placed on the base 12 causing the two seal elements 38,39 to engage.

In the preferred and illustrated embodiment, the first sealing element 38 is an annular resilient pad. The annular resilient pad 38 is positioned in the annular trough 28 such that the resilient pad 38 is mounted to the base 12.

The annular resilient pad 38 positioned in the annular trough 28 is preferably made of ECH (epichlorohydrin closed cell foam) material. This material has heat characteristics which make it more suitable for this application than neoprene rubber. For example, neoprene rubber will permanently deform and fail to return to its original shape when it is exposed to temperatures near 150° F. Once the resilient pad 38 loses its ability to retain its original shape, it loses its effectiveness as a seal. ECH, however, will not permanently deform until exposed to much higher temperatures of near 300° F.

The second sealing element 39 comprises an annular ring projecting from the annular load bearing plate 34. The annular ring 39 deforms the resilient pad 38 to form a seal when the cover 11 is rested on the base 12. The distance the annular ring 39 extends from the annular load bearing plate 34 determines the degree of penetration of the resilient pad 38 by the annular ring 39. This degree of penetration of the pad 38 does not change with repeated replacement of the cover 11 because the penetration is limited by the load bearing area 27.

The base-supported cooling jacket 19 and the cover-supported cooling jacket 32 cooperate to form an enclosure surrounding the first and second seal elements 38,39. This arrangement provides optimal cooling and prevents the material deterioration accompanying high temperatures such as hardening of elastomers. Additionally, the seal arrangement of the present invention preserves the life of the seal elements 38,39 by providing load bearing area 27 apart from the seal elements 38,39. Finally, the arrangement of the present invention positions the resilient pad 38 on the base 12 facing upwards facilitating pad replacement when the cover 11 is removed.

Although the invention has been described with a certain degree of particularity, it will be appreciated that the present disclosure of the preferred embodiment has been made only by way of example. Various modifications, adaptations and uses of the invention may occur to persons skilled in the art to which the invention pertains and it is intended in the appended claims to cover all such modifications, adaptations, and uses which come within the true spirit and scope of the invention.

I claim:

1. In a bell type furnace having a cover structure removably supported on a base structure an improved gas seal assembly comprising:

(a) one of the structures defining as endless seal receiving trough;

(b) heat resistant sealing pad material positioned in the trough, the material being capable of resisting permanent deformation, the material including an endless sealing surface;

(c) the other of the structures including an endless ring mechanism positioned when in use in compressing engagement with the pad material surface to effect a fluid seal between the mechanism and the pad;

(d) at least a first of the structures defining a cooling jacket positioned in heat transfer relationship with the trough whereby to cool the material when the furnace is in use;

(e) inlet and outlet conduits communicating with the jacket for circulating a cooling medium through the jacket when the furnace is in use; and, (f) the structure including coacting elements supporting the cover structure on the base structure when in use while permitting and at the same time limiting compression of the pad material by the surface engaging ring mechanism.

2. In the bell type furnace of claim 1, wherein said heat resistant sealing pad material is foam material having physical properties of epichlorohydrin closed cell foam.

3. In the bell type furnace of claim 1, wherein said endless seal receiving trough is located in said base structure.

4. In the bell type furnace of claim 1, wherein said endless seal receiving trough, said heat resistant sealing pad material positioned in the trough and said endless ring mechanism are annular.

5. In the bell type furnace of claim 1, wherein said cooling jacket is located in said base structure.

6. In the bell type furnace of claim 1, wherein said heat resistant sealing pad material is comprised of epichlorohydrin closed cell foam.

7. In a bell type furnace having a cover structure removeably supported on a base structure, an improved gas-tight seal assembly, comprising:

(a) said base structure defining an annular, endless, seal receiving trough;

(b) heat resistant, sealing, pad material, comprised of epichlorohydrin closed cell foam, positioned in said trough, said material being capable of resisting permanent deformation at temperatures near 300° F., said material including an annular, endless, sealing surface;

(c) said cover structure including an annular, endless, ring mechanism positioned when in use in compressing engagement with said pad material surface to effect a fluid seal between said mechanism and said pad;

(d) at least said base structure defining a cooling jacket positioned in heat transfer relationship with said trough whereby to cool said pad material when the furnace is in use;

(e) inlet and outlet conduits communicating with said jacket for circulating a cooling medium through said jacket when the furnace is in use; and, (f) the structures including coacting elements supporting the cover structure on the base structure when in use while permitting and at the same time limiting compression of said pad material by said surface engaging ring mechanism.

* * * * *